United States Patent [19]

Nebzydoski et al.

[11] 4,064,059

[45] Dec. 20, 1977

[54] SYNTHETIC AIRCRAFT TURBINE OIL

[75] Inventors: John W. Nebzydoski; Edwin L. Patmore, both of Fishkill, N.Y.

[73] Assignee: Texaco Inc., New York, N.Y.

[21] Appl. No.: 317,447

[22] Filed: Dec. 21, 1972

[51] Int. Cl.[2] ..... C10M 1/10

[52] U.S. Cl. ..... 252/49.9; 252/50; 252/51.5 R; 252/51.5 A; 252/56 S

[58] Field of Search ..... 252/49.9, 50, 51.5 R, 252/51.5 A, 56 S

[56] References Cited

U.S. PATENT DOCUMENTS

| | | | |
|---|---|---|---|
| 3,247,111 | 4/1966 | Oberright et al. | 252/50 X |
| 3,282,840 | 11/1966 | Foster et al. | 252/51.5 A X |
| 3,360,465 | 12/1967 | Warman | 252/56 S |
| 3,368,975 | 2/1968 | Davis et al. | 252/56 S X |
| 3,673,226 | 6/1972 | Malec | 252/49.9 X |
| 3,728,260 | 4/1973 | Flowerday et al. | 252/49.9 X |
| 3,759,829 | 9/1973 | Sullivan | 252/50 |
| 3,761,405 | 9/1973 | Jervis et al. | 252/50 X |
| 3,788,992 | 1/1974 | Sullivan | 252/50 |
| 3,790,478 | 2/1974 | Rudston et al. | 252/49.9 X |
| 3,790,481 | 2/1974 | Byford et al. | 252/49.9 |

FOREIGN PATENT DOCUMENTS

| | | | |
|---|---|---|---|
| 250,649 | 5/1963 | Australia | 252/56 S |
| 1,502,381 | 12/1966 | France | 252/51.5 A |

OTHER PUBLICATIONS

Barnes et al., "Synthetic Ester Lubricants," Aug. 1957, J. of Amer. Soc. of Lub. Eng., pp. 454–458.

*Primary Examiner*—Delbert E. Gantz
*Assistant Examiner*—Andrew H. Metz
*Attorney, Agent, or Firm*—Thomas H. Whaley; Carl G. Ries; J. J. O'Loughlin

[57] ABSTRACT

Synthetic lubricating oil composition comprising a major portion of an aliphatic ester base oil having lubricating properties formed from the reaction of a pentaerythritol or trimethylolpropane and an organic monocarboxylic acid containing (a) from about 0.01 to 0.5 percent of a substituted 4-aminotriazole; (b) from about 0.3 to 5 percent of an alkyl or alkaryl phenylnaphthylamine; (c) from about 0.3 to 5 percent of a dialkyldiphenylamine; and (d) from about 0.25 to 10 percent of a hydrocarbyl phosphate ester.

13 Claims, No Drawings

SYNTHETIC AIRCRAFT TURBINE OIL

BACKGROUND OF THE INVENTION

1. Field of Invention

This invention is concerned with the lubricating oil composition used in gas turbine or jet engines. Gas turbine engines are operated under extreme environmental conditions. The lubricant must be fluid at extremely low temperatures and must be an effective lubricant in an engine which produces internal engine temperatures in the range of 450°–500° F. or above. These operating conditions put severe stresses on the lubricating oil, so much so that the most advanced mineral lubricating oil compositions cannot be employed in gas turbine engines.

Currently, synthetic ester base lubricating oil compositions containing a critically balanced blend of additives are being effectively employed for lubricating gas turbine engines. These ester base oils are operative over a wide temperature range and exhibit high thermal stability, anti-wear, load-carrying and anti-oxidation properties while providing good lubrication.

With the advent of newer and more powerful gas turbine engines designed to provide advanced levels of supersonic flight, higher levels of thermal and oxidative stresses are imposed on the lubricating oil. It is also important to reduce or prevent metal staining and corrosion by the oil composition.

DESCRIPTION OF THE PRIOR ART

U.S. Pat. No. 3,427,111 discloses a synthetic lubricating oil composition employing a pentaerythritol ester base containing (1) arylamine type anti-oxidants, such as diphenylamine and phenyl-alpha-naphthylamine, (2) a copper surface passivator, namely a salt of 1-salicylalaminoguanidine and a $C_{14-18}$ aliphatic carboxylic acid, (3) a metal deactivator, namely a polyhydroxyanthraquinone and (4) an organic phosphorus ester in the form of a phosphate or a phosphite.

U.S. Pat. No. 3,330,763 discloses a synthetic lubricating oil composition having improved load-carrying properties employing a pentaerythritol ester base oil containing in combination an ammonium thorcyanate and a cyclic amine compound of the type represented by phenyl-alpha-naphthylemine.

British Pat. No. 1,180,387 discloses a synthetic lubricating oil composition containing a copper passivator of the azole type, salicylaldehyde and hydrazine.

A co-pending application, Ser. No. 160,192 filed July 6, 1971 discloses a synthetic lubricating oil composition containing an ammonium thiocyanate.

U.S. Pat. No. 3,414,618 discloses anti-oxidants for synthetic ester base lubricating oil compositions comprising the class of alkylphenyl naphthylamines.

SUMMARY OF THE INVENTION

The synthetic lubricating oil composition of the invention comprises a major portion of an aliphatic ester base oil having lubricating properties containing a substituted 4-aminotriazole, an alkylphenyl or alkarylphenyl naphthylamine, a dialkyldiphenylamine, and a hydrocarbyl phosphate. More specifically, the lubricating oil composition of the invention comprises a major portion of an aliphatic ester base oil formed from the reaction of a pentaerythritol of trimethylolpropane and an organic monocarboxylic acid having from about 2 to 18 carbon atoms per molecule containing:

a. from about 0.01 to 0.5 weight percent of a substituted 4-aminotriazole represented by the formula:

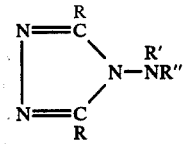

in which R is hydrogen or an alkyl radical having 1 to 4 carbon atoms, R′ is hydrogen, and R″ represents an acyl, hydroxy-substituted acyl or carboxy-substituted acyl radical having the formula —0CR″ in which R″ has from 2 to 18 carbon atoms, or R″ is an aliphatic hydrocarbon radical having from 6 to 18 carbon atoms, or in which R and R′ jointly represent a hydrocarbylidene radical or a hydroxy-substituted hydrocarbylidene radical having from 8 to 18 carbon atoms or an amine salt of said substituted 4-aminotriazole.

b. from about 0.3 to 5 percent by weight of the lubricating oil composition of alkyl or alkaryl derivatives of phenyl-α-or-β-naphthylamines in which the alkyl radicals have from 4 to 12 carbon atoms, c. from about 0.3 to 5 percent of a dialkyldiphenylamine in which the alkyl radicals have from 4 to 12 carbon atoms, and d. from about 0.25 to 10 percent of a hydrocarbyl phosphate in which said hydrocarbyl radical contains an aryl ring and has from ahout 6 to 18 carbon atoms.

The lubricating oil of the invention provides outstanding thermal and oxidative stability and effectively reduces or prevents metal staining and corrosion. These valuable properties were obtained from a novel critically balanced synthetic ester base lubricating oil blend. The results were surprising and unexpected because they equal or surpass commercial synthetic ester base lubricating oil compositions and were obtained without using a metal-staining additive heretofore considered essential for the production of a commercial synthetic lubricating oil.

The base fluid component of the lubricant of the invention is an ester-base fluid prepared from pentaerythritol or trimethylolpropane and a mixture of hydrocarbyl monocarboxylic acids. Polypentaerythritols can also be employed in the reaction to prepare the base oil.

The hydrocarbon monocarboxylic acids which are used to form the ester-base fluid include the straight-chain and branched-chain aliphatic acids, cycloaliphatic acids and aromatic acids as well as mixtures of these acids. The acids employed have from about 2 to 18 carbon atoms per molecule, and preferably from about 5 to 10 carbon atoms. Examples of suitable specific acids are acetic, propionic, butyric, valeric, isovaleric, caproic, decanoic, hexadecanoic, vinylbenzoic, dodecylbenzoic, pelargonic, decanoic, cyclohexanoic, naphthenic, benzoic acid, phenylacetic, tertiary-butylacetic acid and 2-ethylhexanoic acid.

In general, the acids are reacted in proportions leading to a completely esterified pentaerythritol or trimethylolpropane with the preferred ester bases being the pentaerythritol tetraesters. Examples of such commercially available tetraesters include pentaerythritol tetracaproate, which is prepared from purified pentaerythritol and crude caproic acid containing other $C_{5-10}$ monobasic acids. Another suitable tetraester is prepared from a technical grade pentaerythritol and a mixture of acids comprising 38 percent valeric, 13 percent 2-methyl pentanoic, 32 percent octanoic and 17 percent pelargonic acids. Another effective ester is the triester of trimethylolpropane in which the trimethylolpropane is esterified with a monobasic acid mixture consisting of 2 percent valeric, 9 percent caproic, 13 percent heptanoic, 7 percent octanoic, 3 percent caprylic, 65 percent pelargonic and 1 percent capric acids. Trimethylolpropane triheptanoate, trimethylolpropanepentanoate and trimethylolpropanehexanoate are also suitable ester bases.

The ester base comprises the major protion of the fully formulated synthetic ester base lubricating oil composition. In general, this ester base fluid is present in concentration of from about 90 to 98 percent of the composition.

The essential substituted 4-aminotriazole component of the lubricating oil composition of the invention is represented by the formula:

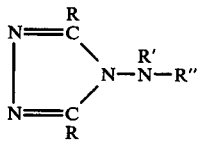

in which R is hydrogen or an alkyl radical having from 1 to 4 carbon atoms, R′ is hydrogen and R″ represents an acyl, hydroxy-substituted acyl or carboxy-substituted acyl radical having the formula —OCR″ in which R″ has from 2 to 18 carbon atoms or R″ is an aliphatic hydrocarbon radical having from 6 to 18 carbon atoms, or in which R′ and R″ taken together represent a hydrocarbylidene radical or a hydroxy-substituted hydrocarbylidene radical having from 8 to 18 carbon atoms, or an amine salt of said substituted 4-aminotriazole.

A subgeneric class of substituted 4-aminotriazoles is represented by the formula:

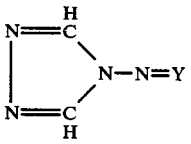

in which Y is a divalent hydrocarbylidene or hydroxy-substituted hydrocarbylidene radical having from 8 to 18 carbon atoms. The hydrocarbylidene radical can be an alkylidene, arylidene, or hydroxy-substituted alkylidene or arylidene. The following examples illustrate the preparation of these compounds.

EXAMPLE I

Salicylidene-4-Amino-1,2,4-Triazole 4-amino-1,2,4-triazole (4.2 g.), salicylaldehyde (6.1g.) and xylene 140 ml. were heated at reflux for 3 hr. The reaction mixture was cooled and filtered to afford 9 grams of product, m.p. 210°-12°.

%N-Calc. 29.8, found 29.6

EXAMPLE II

Benzylidene-4-Amino-1,2,4-Triazole 4-amino-1,2,4-triazole (8.4g.), benzaldehyde (10.6g.) and xylene (100 mg.) were heated in a Dean Stack apparatus until the evolution of water ceased. Cooling, diluting with 50 ml. of benzene and filtering afforded 19g. of product, m.p. = 171°-3°.

%N-Calc. 32.6, found 32.4

EXAMPLE III

Dodecylidene-4-Amino-1,2,4-Triazole 4-amino-1,2,4-triazole (8.4g.), didecyl aldehyde (18.4g.) and xylene (125 ml.) were heated in a Dean Stack apparatus until the evolution of water ceased. Concentration on the rotary afforded the product as a viscous oil which solidified upon cooling. Yield = 25g. m.p. 40°-3°.

%N-Calc. 22.4, found 22.7

Another subgeneric class of the substituted 4-aminotriazoles is represented by the formula:

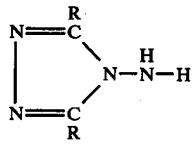

in which R has the value noted above.

Examples of the preparation of these derivations of 4-amino-1,2,4-triazole are illustrated below:

EXAMPLE IV

4-Amino-1,2,4-Triazole

85% hydrazine hydrate (120g.) was slowly added to a stirred solution of ethyl formate (148g.) and 95% ethanol (150 ml.). The reaction, which became warm during the addition, was then heated at reflux for 18 hr. Ethanol and water were removed under reduced pressure until the volume of the reactants was about 150 ml. The vacuum was removed and the reactants warmed to 200° C. over 2-3 hr. period. The reactants were cooled, diluted with 30 ml. of ethanol, treated with a filter aid and filtered. Dilution of the filtrate with 75 ml. of ether caused the product to precipitate. Filtration and washing with an ether/ethanol solution afforded 63g. of the named product, m.p. 77°-82° C. Ref.: Org Syn, Coll. Vol III, p97.

EXAMPLE V

3,5-Dimethyl-4-Amino 1,2,4Triazole

85% hydrazine hydrate (43g.) was slowly added to acetic acid (30g.) with stirring. The reactants were heated at 220°-30° C. for 5 hr. with continuous removal of water. The reaction mixture was cooled, diluted with 75 ml. of isopropanol and allowed to cool further to 0° C. The precipitated product was collected by filtration. Yield — 15g., m.p. —204° C. Ref. J.O.C. 18, 872.

Another subgeneric class of the substituted 4-aminotriazoles is represented by the formula:

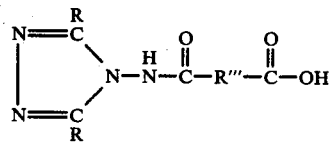

in which R has the value noted above and R‴ is an alkylene radical having from 2 to 18 carbon atoms. Examples of the preparation of these materials follows.

EXAMPLE VI

Mixture of 2-and 3-Dodecyl-N-(4-1,2,4-Triazolyl) Succinamic Acid

A solution of 4-amino-1,2,4-triazole (4.2g.) and dodecyl succinic anhydride (13.4g.) and toluene (100 ml.) was heated at reflux for 2 hr. Removal of the toluene under reduced pressure afforded 18g. of product.

%N = 16.0, Calc. 15.9

EXAMPLE VII

Mixture of 2-and 3-Tetrapropenyl-N-(4-1,2,4-Triazolyl) Succinamic Acid

A solution of 26.6g. of tetrapropenyl succinic anhydride, 8.4g. of 4-amino-1,2,4-triazole and 150 ml. of benzene was heated at reflux for 3 hr. Filtration and concentration of the filtrate afforded 36g. of product.

%N = 14.6, Calc. 15.9

Amine salts of the foregoing succinamic acid derivation of 4-amino-1,2,4-triazoles are also suitable in the ester base lubricants of the invention. These are prepared by refluxing a suitable amine with approximately an equivalent amount of the succinamic acid derivative of 4-amino-1,2,4-triazole in benzene until the salt has formed followed by removal of the solvent under reduced pressure. The amine employed is preferably a primary monoamine represented by the formula R'''' $NH_2$ in which R'''' is an aliphatic hydrocarbon radical having from 1 to 18 carbon atoms. Examples of these salts are as follows:

EXAMPLE VIII

Tertiary $C_{12-14}$Alkyl Amine Salts of 2-Dodecyl-N-(4-1,2,4-Triazolyl)-Succinamic Acid and the corresponding 3-Dodecyl derivative.

EXAMPLE IX

Tertiary $C_{18-22}$Alkyl Amine Salts of 2-Dodecyl-N-(4-1,2,4-Triazolyl)-Succinamic Acid and the corresponding 3-Dodecyl derivative.

EXAMPLE X

Secondary $C_{15}$-Alkyl Amine Salts of 2-Dodecyl-N-(4-1,2,4-Triazolyl)-Succinamic Acid and the corresponding 3-Dodecyl derivative.

EXAMPLE XI

Tertiary $C_{12-14}$Alkly Amine Salts of 2-Tetrapropenyl-N(4-1,2,4-Triazolyl)-Succinamic Acid and the corresponding 3-Tetrapropenyl derivative.

EXAMPLE XII

Tertiary $C_8$ Alkyl Amine Salts of Tetrapropenyl-N-(4-1,2,4-Triazolyl)-Succinamic Acid and the corresponding 3-Tetrapropenyl derivative.

The essential alkyl or alkaryl phenyl naphthylamine component of the invention is represented by the formula:

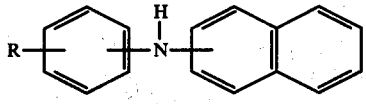

in which R is an alkyl or alkaryl radical having from about 4 to 12 carbon atoms. This radical can be a straight or branched chain alkyl radical with the tertiary alkyl structure being preferred or it can be an alkylaryl radical. The naphthylamine can be either an alpha or beta naphthylamine. Specific effective compounds of this class include N-p-t-octylphenyl-α-naphthylamine, N-(p-α-cumylphenyl)-6-α-cumyl-B-naphthylamine, N-p-t-octylphenyl-β-naphthylamine and the corresponding p-t-dodecylphenyl, p-t-butylphenyl, and p-dodecylphenyl-α and -β-naphthylamines. The preferred concentration of this component is from about 0.5 to 2.5 percent.

Another essential component of the lubricating oil composition of the invention is a dialkyldiphenylamine. These compounds are represented by the formula:

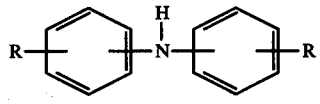

in which R is an alkyl radical having from about 4 to 12 carbon atoms. Suitable alkylamines include dioctyldiphenylamine, didecyldiphenylamine, didocyldiphenylamine, dihexyldiphenylamine and similar compounds. Dioctyldiphenylamine is the preferred compound and the preferred concentration is from 0.5 to 2.0 percent.

The final essential component of the lubricating oil composition of the invention is a hydrocarbylphosphate ester, more specifically a trihydrocarbyl phosphate having the formula $(RO)_3PO$ in which R is a hydrocarbyl radical is an alkyl, aryl, alkaryl, cycloalkyl or aralkyl radical or mixture thereof having from 2 to 12 carbon atoms and preferably from 4 to 8 carbon atoms. Effective specific compounds include tricresylphosphate, cresyl diphenylphosphate, triphenylphosphate, tributylphosphate, tri(2-ethylhexyl)phosphate and tricyclohexyl phosphate. These compounds are preferably present in the lubricating oil composition in a concentration ranging from about 0.5 to 5 percent.

The lubricating oil composition of the invention was tested for its oxidation and corrosion resistance in oxidation-corrosion tests described below:

The 400° F/72 Hr and 425° F/48 Hr Oxidation and Corrosion Tests are conducted in accordance with Method 5308.4 of Federal Test Method and Standard No. 791*a* (issued Dec. 31, 1961) except for modifications to conform to MIL-L-23699B specifications. The bath temperature is maintained at 400 and 425° F ± 1° F., respectively, instead of at 250° F. and the tests are conducted for periods of 72 hours and 48 hours instead of 168 hours as specified in the original test.

The ester base oils employed in preparing the lubricating oil compositions tested below comprised pentaerythritol containing a minor amount of dipentaerythritol esterified with mixtures of fatty acids.

Base Oil A consisted of technical grade pentaerythritol ester made from a mixture of carboxylic acid consisting of (mole %):

| | |
|---|---|
| i — $C_5$ | 8 ± 3% |
| n — $C_5$ | 23 ± 5 |
| n — $C_6$ | 20 ± 5 |
| n — $C_7$ | 27 ± 5 |
| n — $C_8$ | 7 ± 3 |
| n — $C_9$ | 16 ± 3 |

This ester base oil had the following properties:

| | |
|---|---|
| Viscosity, cs at 210° F | 5.01 |
| Viscosity, cs at 100° F | 25.6 |
| Viscosity, cs at −40° F | 7005 |
| Viscosity Index | 140 |
| Flash, ° F | 515 |

Base Oil B was similar to Base Oil A but consisted of pentaerythritol ester made from the following mixture of carboxylic acids (mole %):

| | |
|---|---|
| i — $C_5$ | 10 ± 3 |
| n — $C_5$ | 22 ± 5 |
| n — $C_6$ | 7 ± 5 |
| n — $C_7$ | 15 ± 5 |
| n — $C_8$ | 22 ± 5 |
| n — $C_9$ | 17 ± 5 |
| n — $C_{10}$ | 1 Max |

Four base fluids were prepared employing the foregoing base oils. These had the following compositions:

Base Fluid A consisted of 1.0 weight percent of p,p'-di-tert.-octyldiphenylamine, 1.5 weight percent of N-(p-t-octylphenyl)-1-naphthylamine, and 2.0 weight percent tricresylphosphate and the balance Base Oil A referred to above.

Base fluid B was similar to Base fluid A above except that it was prepared using Base Oil B.

Base Fluid C was similar to Base Fluid A except that N-4-(cumylphenyl)-6'-amyl-2-naphthylamine replaced N-(p-t-octylphenyl)-1-naphthylamine.

Base Fluid D was similar to Base Fluid C except that it was prepared using Base Oil B instead of Base Oil A.

The Oxidation-Corrosion Test result obtained employing the ester base lubricants of this invention are set forth in Table I below.

TABLE I

EVALUATION OF SUBSTITUTED 4-AMINO-1,2,4-TRIAZOLES

| | | | | Oxidation-corrosion Test Results | | | | | | | |
|---|---|---|---|---|---|---|---|---|---|---|---|
| | | | | 400° F./72 hr. | | | | 425° F/48 hrs. | | | |
| Run | Additive and | Conc. | Base Fluid | Metal Wt. Change (Mg./em²) Cu | Metal Wt. Change (Mg./em²) Mg | Vis. Inc. (100° F) | TAN Inc. | Metal Wt. Change (Mg./cm²) Cu | Metal Wt. Change (Mg./cm²) Mg | Vis. Inc. | TAN Inc. |
| 1 | None | — | A | −0.60 | 0.0 | 16.3 | 1.23 | −1.35 | −0.04 | 22.2 | 2.10 |
| 2 | None | — | B | −0.54 | 0.0 | 23.0 | 1.86 | −1.29 | −0.02 | 27.8 | 2.50 |
| 3 | None | — | C | −0.50 | 0.0 | 21.2 | 0.93 | −2.13 | −0.04 | 28.20 | 2.60 |
| 4 | None | — | D | −1.29 | −0.12 | 25.8 | 2.36 | −1.42 | −0.09 | 28.8 | 2.66 |
| 5 | Example I | 0.05 | B | −0.11 | 0.0 | 18.9 | 0.78 | −0.25 | −0.02 | 27.2 | 2.28 |
| 6 | Example I | 0.1 | B | −0.07 | 0.0 | 22.0 | 0.62 | −0.10 | 0.0 | 29.0 | 1.97 |
| 7. | Examplle II | 0.1 | D | −0.18 | −0.05 | 18.3 | 1.26 | −0.02 | −0.09 | 17.5 | 1.73 |
| 8. | Example III | 0.1 | D | −0.12 | 0.0 | 22.5 | 1.96 | −0.18 | −0.05 | 20.5 | 2.26 |
| 9 | Example IV | 0.1 | B | 0.06 | 0.0 | 3.9 | 0.30 | −0.12 | 0.0 | 25.1 | 1.87 |
| 10. | Example V | 0.1 | D | −0.09 | 0.0 | 17.3 | 0.58 | −0.11 | 0.0 | 18.7 | 1.26 |
| 11. | Example VI | 0.1 | D | −0.09 | 0.0 | 16.9 | 0.98 | −0.13 | −0.02 | 22.6 | 2.57 |
| 12. | Example VI | 0.1 | B | −0.14 | −0.06 | 18.0 | 0.76 | −0.16 | 0.0 | 19.1 | 1.44 |
| 13. | Example VII | 0.1 | D | — | — | — | — | −0.10 | −0.04 | 22.4 | 2.0 |
| 14. | Example VIII | 0.1 | D | −0.09 | −0.02 | 20.3 | 1.71 | −0.14 | 0.0 | 17.8 | 1.6 |
| 15. | Example IX | 0.1 | D | −0.16 | 0.0 | 25.0 | 2.8 | −0.21 | 0.04 | 23.1 | 1.9 |
| 16. | Example X | 0.1 | D | −0.040 | 0.0 | 20.2 | 2.5 | −0.11 | −0.05 | 19.2 | 2.0 |
| 17. | Example XI | 0.1 | D | −0.21 | −0.02 | 27.0 | 1.4 | −0.18 | 0.0 | 24.3 | 2.8 |
| 18. | Example XII | 0.1 | D | −0.18 | 0.0 | 25.0 | 3.8 | −0.17 | 0.0 | 32.0 | 2.1 |

All of the working examples of the lubricating oil composition of the invention are within the critical specification limits of both the 400° F/72 hour and the 425°/48 hour oxidation-corrosion tests. For the 400°/72 hour test the specification metal weight changes in mg/cm² are ±0.40 for copper and +0.20 for magnesium and the percent viscosity increase at 100° F is −5 to +25 and the TAN increase (Total Acid Number) is 3.0 max. In the 425° F/48 hour test, the specification metal weight change is ±0.30 for both copper and magnesium and the percent viscosity increase at 100° F is 50% maximum.

This invention provides a novel ester base lubricating oil composition having outstanding oxidation and corrosion resistance and which overcomes a serious metal staining problem in gas turbine engines.

We claim:

1. A synthetic lubricating oil composition comprising a major portion of an aliphatic ester base oil having lubricating properties formed from the reaction of a pentaerythritol or trimethylolpropane and a saturated hydrocarbyl monocarboxylic acid having from about 2 to 18 carbon atoms per molecule, containing A. From about 0.01 to 0.5 weight percent of a substituted 4-amminotriazole represented by a formula selected from the group consisting of:

a.

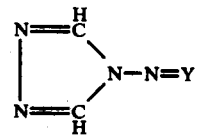

b.

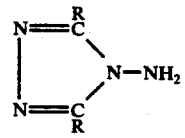

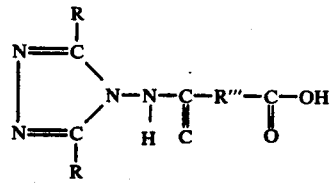

d. The amine salt of (c) in which the amine is a primary monoamine represented by the formula:

$R''''NH_2$ in which Y is a hydrocarbylidene radical or hydroxy-substituted hydrocarbylidene radical having from 8 to 18 carbon atoms, R is hydrogen or an aliphatic hydrocarbon radical having from 1 to 4 carbon atoms R''' is an alkylene radical having from 2 to 18 carbon atoms, and R'''' is an aliphatic hydrocarbon radical having from 1 to 18 carbon atoms B. From about 0.3 to 5 percent by weight of the lubricating oil composition of an alkyl or alkarylphenyl naphthylamine represented by the formula:

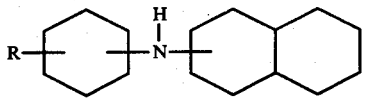

in which R is an alkyl or alkaryl radical having from about 4 to 12 carbon atoms, C. From about 0.3 to 5 percent of a dialkyldiphenyamine in which the alkyl radicals have from 4 to 12 carbon atoms, and D. From about 0.25 to 10 percent of a trihydrocarbyl phosphate in which said hydrocarbyl radical contains an aryl ring and contains from about 6 to 18 carbon atoms.

2. A lubricating oil composition according to claim 1 containing from about 0.5 to 2.5 percent of an octylphenyl-$\alpha$ or $\beta$ naphthylamine, from about 0.5 to 2.0 percent of a dioctyldiphenylamine, and from about 0.5 to 5 percent of a trihydrocarbyl phosphate.

3. A lubricating oil composition according to claim 1 in which said aliphatic ester beam oil is formed from the reaction of pentaerythritol with a mixture of aliphatic acids having from about 5 to 10 carbon atoms.

4. A lubricating oil composition according to claim 1 in which said aliphatic ester base oil comprises the reaction of pentaerythritol with substantial proportions of isovaleric, valeric, caproic, heptylic, caprylic and pelargonic acids in which the average acid carbon chain length is between 6 and 7.

5. A lubricating oil composition according to claim 1 in which said ester base oil is formed from pentaerythritol and saturated aliphatic acids having from 5 to 10 carbon atoms, said naphthylamine is monooctylphenyl-alpha-naphthylamine at a concentration of 0.5 to 2.5 percent, said dialkyldiphenylamine is dioctyldiphenylamine at a concentration of 0.5 to 2 percent, and said trihydrocarbyl phosphate is triscresyl phosphate at a concentration of 0.5 to 5 percent.

6. A lubricating oil composition according to claim 1 containing from about 0.03 to 0.3 weight percent of said substituted 4-aminotriazole.

7. A synthetic lubricating oil composition comprising a major portion of an aliphatic ester base oil having lubricating properties formed from the reactions of a pentaerythritol or trimethylolpropane and a saturated hydrocarbyl monocarboxylic acid having from about 2 to 18 carbon atoms per molecule, containing A. From about 0.01 to 0.5 weight percent of a substituted 4-aminotriazole represented by the formula:

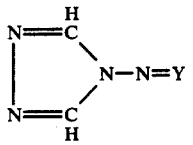

in which Y is a hydrocarbylidene radical or hydroxy-substituted hydrocarbylidene radical having from 8 to 18 carbon atoms, B. From about 0.3 to 5 percent by weight of the lubricating oil composition of an alkyl or alkarylphenyl naphthylamine represented by the formula:

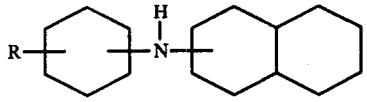

in which R is an alkyl or alkaryl radical having from about 4 to 12 carbon atoms, C. From about 0.3 to 5 percent of a dialkyldiphenylamine in which the alkyl radicals have from 4 to 12 carbon atoms, and D. From about 0.25 to 10 percent of a trihydrocarbyl phosphate in which said hydrocarbyl radical contains an aryl ring and contains from about 6 to 18 carbon atoms.

8. A synthetic lubricating oil composition comprising a major portion of an aliphatic ester base oil having lubricating properties formed from the reaction of a pentaerythritol or trimethylolpropane and a saturated hydrocarbyl monocarboxylic acid having from about 2 to 18 carbon atoms per molecule, containing A. From about 0.01 to 0.5 weight percent of a substituted 4-aminotriazole represented by the formula:

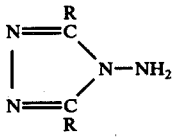

in which R is hydrogen or an aliphatic hydrocarbon radical having from 1 to 4 carbon atoms, B. From about 0.3 to 5 percent by weight of the lubricating oil composition of an alkyl or alkarylphenyl naphthylamine represented by the formula:

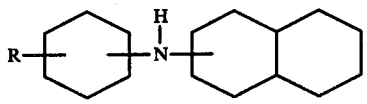

in which R is an alkyl or alkaryl radical having from about 4 to 12 carbon atoms, C. From about 0.3 to 5 percent of a dialkyldiphenyamine in which the alkyl radicals have from 4 to 12 carbon atoms, and D. From about 0.25 to 10 percent of a trihydrocarbyl phosphate in which said hydrocarbyl radical contains an aryl ring and contains from about 6 to 18 carbon atoms.

9. A synthetic lubricating oil composition comprising a major portion of an aliphatic ester base oil having lubricating properties formed from the reaction of a pentaerythritol or trimethylolpropane and a saturated hydrocarbyl monocarboxylic acid having from about 2 to 18 carbon atoms per molecule, containing A. From about 0.01 to 0.5 weight percent of a substituted 4-aminotriazole represented by the formula:

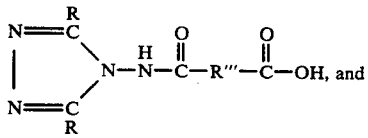

in which R is hydrogen or an aliphatic hydrocarbon radical having from 1 to 4 carbon atoms R''' is an alkylene radical having from 2 to 18 carbon atoms, B. From about 0.3 to 5 percent by weight of the lubricating oil composition of an alkyl or alkarylphenyl naphthylamine represented by the formula:

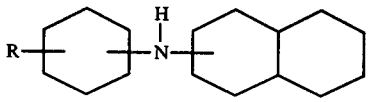

in which R is an alkyl or alkaryl radical having from about 4 to 12 carbon atoms, C. From about 0.3 to 5 percent of dialkyldiphenyamine in which the alkyl radicals have from 4 to 12 carbon atoms, and D. From about 0.25 to 10 percent of a trihydrocarbyl phosphate in which said hydrocarbyl radical contains an aryl ring and contains from about 6 to 18 carbon atoms.

10. A synthetic lubricating oil composition comprising a major portion of an aliphatic ester base oil having lubricating properties formed from the reaction of a pentaerythritol or trimethylolpropane and a saturated hydrocarbyl monocarboxylic acid having from about 2 to 18 carbon atoms per molecule, containing A. From about 0.01 to 0.5 weight percent of N-salicylidene-4-amino-1,2,4-triazole, B. From about 0.3 to 5 percent by weight of the lubricating oil composition of an alkyl or alkarylphenyl naphthylamine represented by the formula:

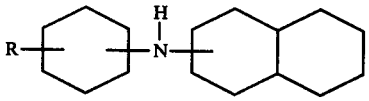

in which R is an alkyl or alkaryl radical having from about 4 to 12 carbon atoms, C. From about 0.3 to 5 percent of a dialkyldiphenyamine in which the alkyl radicals have from 4 to 12 carbon atoms, and D. From about 0.25 to 10 percent of a trihydrocarbyl phosphate in which said hydrocarbyl radical contains an aryl ring and contains from about 6 to 18 carbon atoms.

11. A synthetic lubricating oil composition comprising a major portion of an aliphatic ester base oil having lubricating properties formed from the reaction of a pentaerythritol or trimethylolpropane and a saturated hydrocarbyl monocarboxylic acid having from about 2 to 18 carbon atoms per molecule, containing A. From about 0.01 to 0.5 weight percent of N-benzylidene-4-amino-1,2,4,-triazole, B. From about 0.3 to 5 percent by weight of the lubricating oil composition of an alkyl or alkarylphenyl naphthylamine represented by the formula:

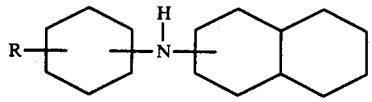

in which R is an alkyl or alkaryl radical having from about 4 to 12 carbon atoms, C. From about 0.3 to 5 percent of a dialkyldiphenylamine in which the alkyl radical have from 4 to 12 carbon atoms, and D. From about 0.25 to 10 percent of a trihydrocarbyl phosphate in which said hydrocarbyl radical contains an aryl ring and contains from about 6 to 18 carbon atoms.

12. A synthetic lubricating oil composition comprising a major portion of an aliphatic ester base oil having lubricating properties formed from the reaction of a pentaerythritol or trimethylolpropane and a saturated hydrocarbyl monocarboxylic acid having from about 2 to 18 carbon atoms per molecule, containing A. From about 0.01 to 0.5 weight percent of N-dodecylidene-4-amino-1,2,4-triazole, B. From about 0.3 to 5 percent by weight of the lubricating oil composition of an alkyl or alkarylphenyl naphthylamine represented by the formula:

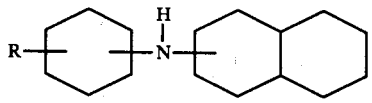

in which R is an alkyl or alkaryl radical having from about 4 to 12 carbon atoms, C. From about 0.3 to 5 percent of a dialkyldiphenyamine in which the alkyl radicals have from 4 to 12 carbon atoms, and D. From about 0.25 to 10 percent of a trihydrocarbyl phosphate in which said hydrocarbyl radical contains an aryl ring and contains from about 6 to 18 carbon atoms.

13. A synthetic lubricating oil composition consisting of 90 to 98 percent of an aliphatic ester base oil having lubricating properties formed from the reaction of a pentaerythritol or trimethylolpropane and a saturated hydrocarbyl monocarboxylic acid having from about 2 to 18 carbon atoms per molecule, containing A. From about 0.01 to 0.5 weight percent of a substituted 4-aminotriazole represented by a formula selected from the group consisting of:

a. 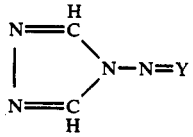

d. The amine salt of (c) in which the amine is a primary monoamine represented by the formula:

$R''''NH_2$ in which Y is a hydrocarbylidene radical or hydroxy-substituted hydrocarbylidene radical having from 8 to 18 carbon atoms, R is hydrogen or an aliphatic hydrocarbon radical having from 1 to 4 carbon atoms R''' is an alkylene radical having from 2 to 18 carbon atoms, and R'''' is an aliphatic hydrocarbon radical having from 1 to 18 carbon atoms B. From about 0.3 to 5 percent by weight of the lubricating oil composition of an alkyl or alkarylphenyl naphthylamine represented by the formula:

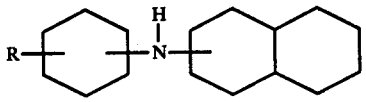

in which R is an alkyl or alkaryl radical having from about 4 to 12 carbon atoms, C. From about 0.3 to 5 percent of a dialkyldiphenyamine in which the alkyl radicals have from 4 to 12 carbon atoms, and D. From about 0.25 to 10 percent of a trihydrocarbyl phosphate in which said hydrocarbyl radical contains an aryl ring and contains from about 6 to 18 carbon atoms.

* * * * *